US009120196B2

(12) United States Patent
Geurts et al.

(10) Patent No.: US 9,120,196 B2
(45) Date of Patent: Sep. 1, 2015

(54) DEVICE FOR DEBLOCKING OPTICAL WORKPIECES, IN PARTICULAR EYEGLASS LENSES

(75) Inventors: Peter Johannes Lodewijk Geurts, GT Horst (NL); Nathan Thomas Costelloe, TN Venlo (NL)

(73) Assignee: Satisloh AG, Baar (CH)

( * ) Notice: Subject to any disclaimer, the term of this patent is extended or adjusted under 35 U.S.C. 154(b) by 374 days.

(21) Appl. No.: 13/582,221

(22) PCT Filed: Feb. 23, 2011

(86) PCT No.: PCT/EP2011/000862

§ 371 (c)(1),
(2), (4) Date: Sep. 28, 2012

(87) PCT Pub. No.: WO2011/107227

PCT Pub. Date: Sep. 9, 2011

(65) Prior Publication Data

US 2013/0061462 A1 Mar. 14, 2013

(30) Foreign Application Priority Data

Mar. 4, 2010 (DE) ..... 10 2010 010 334

(51) Int. Cl.
*B32B 38/10* (2006.01)
*B24B 13/005* (2006.01)

(52) U.S. Cl.
CPC ..... *B24B 13/0057* (2013.01); *Y10T 29/53* (2015.01)

(58) Field of Classification Search
CPC ..... B26F 3/004; B29D 11/0038; B29D 11/00942; G02B 1/043; H01L 21/76254; H01L 21/76259; H01L 2221/68386; H01L 2221/6839; B24B 13/0057
USPC ..... 156/706, 707, 756, 758
See application file for complete search history.

(56) References Cited

U.S. PATENT DOCUMENTS 6,382,292 B1 * 5/2002 Ohmi et al. ..... 156/756
6,436,226 B1 * 8/2002 Omi et al. ..... 156/701

(Continued)

FOREIGN PATENT DOCUMENTS

JP 2006205356 A 8/2006
WO WO 03/018253 A1 3/2003

OTHER PUBLICATIONS

German International Search Report and Written Opinion, International Application No. PCT/EP2011/000862, International Filing Date: Feb. 23, 2011, 8 pages, Sep. 25, 2012.

(Continued)

*Primary Examiner* — Mark A Osele
(74) *Attorney, Agent, or Firm* — Reising Ethington P.C.

(57) ABSTRACT

A device for deblocking optical workpieces, having a first moving device for rotating a workpiece, which is blocked on a blocking piece, about a workpiece rotational axis and a nozzle for dispensing a pressurized stream in a direction that is essentially transverse to the workpiece rotational axis onto a point of incidence in an edge region between the blocking piece and the workpiece. The device also has a second moving device for generating a relative movement between the nozzle and the workpiece. The second moving device has a nozzle guiding portion on which the nozzle is mounted and by which the nozzle can be positioned with respect to the blocking piece in a cam-controlled manner in order to aim the pressurized stream towards the point of incidence in a defined manner.

22 Claims, 7 Drawing Sheets

(56) References Cited

U.S. PATENT DOCUMENTS

| | | | | |
|---|---|---|---|---|
| 6,773,534 | B2 * | 8/2004 | Yanagita et al. | 156/239 |
| 6,945,849 | B2 | 9/2005 | Miyazawa | |
| 7,413,503 | B2 | 8/2008 | Tabata et al. | |
| 7,476,143 | B2 | 1/2009 | Shibata | |
| 7,946,325 | B2 | 5/2011 | Kawakubo et al. | |
| 8,141,220 | B2 * | 3/2012 | Guardia Aura | 29/426.4 |
| 2001/0001975 | A1 * | 5/2001 | Sakaguchi et al. | 156/239 |
| 2002/0045327 | A1 * | 4/2002 | Yanagita et al. | 438/459 |
| 2004/0099111 | A1 * | 5/2004 | Adkins | 83/98 |
| 2008/0132157 | A1 | 6/2008 | Schneider et al. | |
| 2010/0170635 | A1 | 7/2010 | Savoie | |
| 2011/0033615 | A1 | 2/2011 | Breme et al. | |
| 2011/0067628 | A1 | 3/2011 | Savoie et al. | |
| 2011/0220018 | A1 | 9/2011 | Schafer et al. | |
| 2012/0205847 | A1 | 8/2012 | Pavel et al. | |

OTHER PUBLICATIONS

International Preliminary Report on Patentability, International Application No. PCT/EP2011/000862, International Filing Date: Feb. 23, 2011, 8 pages (English Version), Sep. 25, 2012.

* cited by examiner

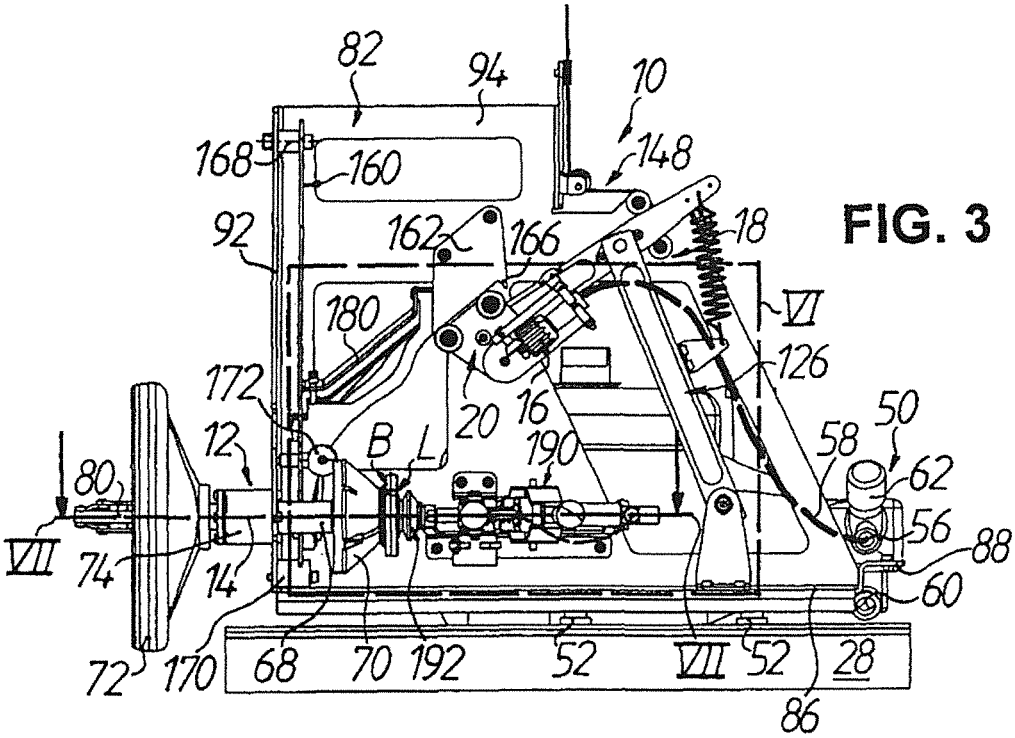
FIG. 3
FIG. 4
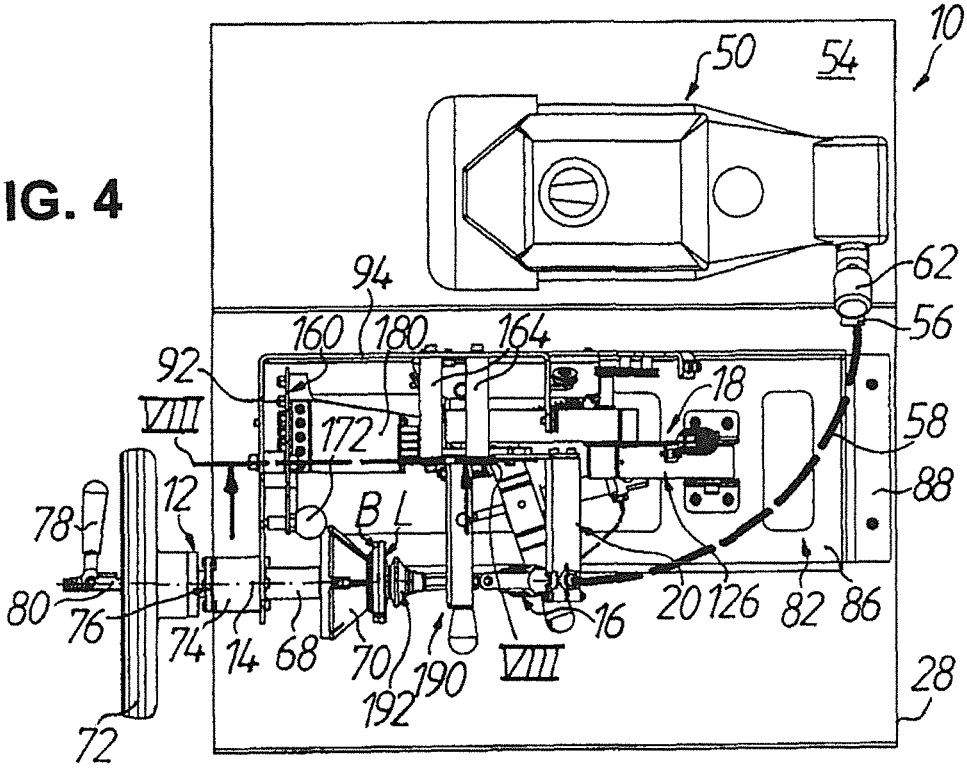

DEVICE FOR DEBLOCKING OPTICAL WORKPIECES, IN PARTICULAR EYEGLASS LENSES

TECHNICAL FIELD

The present invention relates generally to a device for deblocking optical workpieces.

Generally termed "block mounting" or, for short, "blocking" in optical production is the procedure in which an optical workpiece is temporarily fastened by a suitable material (alloy with low melting temperature or adhesive) on a so-called "block piece" or, however, the blocking material is mounted on the workpiece so as to construct the block piece itself, which then serves the purpose of holding the workpiece in the respective processing machine and/or coating plant. A corresponding meaning attaches in optical production to the procedure of "deblocking" in which the optical workpiece after (final) processing thereof (at surface and/or edge) and/or coating is again separated from the block piece or blocking material.

The invention particularly relates to a device for deblocking spectacle lenses. Spectacle lenses are blocked en masse in so-called "RX workshops" before the respective blocked spectacle lens is subjected to material-removing processing at its back or front surface with respect to its optical effect and/or at the edge for adaptation to an associated spectacle frame by geometrically defined cutting (milling/turning) or geometrically non-defined cutting (grinding/polishing) and/or to coating on its back or front surface for achieving additional effects for example increase in scratch resistance, anti-reflection characteristics, metallising, hydrophobic characteristics, etc.

If, in the following, in conjunction with the present invention there is reference in general to "spectacle lenses" as a preferred field of use there is to be understood by that optical lens or lens blanks for spectacles of customary materials such as polycarbonate, mineral-glass, CR 39, HI-index, etc., and with any starting shape of the circumferential edge of the lens or lens blank, which prior to blocking can already be—but does not have to be—pre-processed and/or pre-coated at an optically effective surface or at both optically effective surfaces and/or at the edge. In addition, the spectacle lens can be provided on its surface, at which it is or will be blocked, with a film, a lacquer or the like in order to protect this surface from contamination and damage and/or to improve the adhesion characteristics between spectacle lens and blocking material, without this actually being mentioned on each occasion in the following.

BACKGROUND OF THE INVENTION

There is no lack of proposals in the prior art on how a device for deblocking spectacle lenses can be constructed, wherein use is made of a pressure medium such as water in order to release the spectacle lens from the block piece by application of hydraulic forces and, in particular, either from "inside" by way of a pressure-medium channel in the block piece, which opens at the blocking surface of the block piece facing the spectacle lens (for example, DE 10 2005 038 063 A1, FIG. 12; WO 03/018253 A1, FIG. 4), or from the "outside" by a high-pressure water jet which is delivered by a nozzle and which is incident on an edge location between block piece and spectacle lens (for example, WO 2008/003805 A1, FIG. 1).

A disadvantage of the "inside" application of the hydraulic forces is that the block piece is provided with cavities which are open towards the blocking surface and which oppose a desirable whole-area support of the spectacle lens on the block piece. The opening in the blocking surface can in principle be reduced in size in order to achieve an approximately whole-area support, but then it is hardly possible to apply the hydraulic forces required in order to separate the spectacle lens from the block piece.

The use here of a small piston in the (separate) block piece, which bounds the blocking surface, as proposed as an alternative in WO 03/018253 A1 (FIGS. 14 to 22), can admittedly be of assistance. However, mechanical forces are then applied by way of this piston during the deblocking to a relatively small, central area at the spectacle lens, which can have the consequence of destroying the spectacle lens. In any event, for the detaching it is necessary to generate forces which are higher than the adhesion forces between spectacle lens and block piece. In the case of the above-described piston solution the releasing forces act exclusively axially on the center of the spectacle lens, whereas the adhesion forces act predominantly in an annular zone at the spectacle lens edge. This can lead, particularly in the case of thin spectacle lenses, to comparatively strong deformations and high stresses in the spectacle lens to be deblocked, which ultimately can produce breakage of the spectacle lens, never mind the cost involved in providing such a piston in the block piece.

The previously known "outside" solution according to WO 2008/003805 A1, does indeed make possible a whole-area support of the spectacle lens at the block piece and beyond that reduces the risk of damage of the spectacle lens during deblocking, but this prior art is in need of improvement in another respect.

The deblocking method disclosed there was developed specifically for the deblocking of spectacle lenses blocked by a thermoplastic blocking material. In that case, melting of the blocking material is initially constrained by immersion of the composite of spectacle lens, blocking material and block piece in a bath with hot water. Block piece and blocking material as well as a protective film on the spectacle lens are then detached from the spectacle lens by a high-pressure water jet. For this purpose the water of the jet is heated to a temperature between 50° C. and 65° C. so as to further soften the blocking material and ultimately liquefy it a consequence of the heating. The high-pressure water jet is here fanned relatively widely and is, in addition, rotated about the longitudinal axis of the nozzle in order to also penetrate under the protective foil on the rotating spectacle lens and lift the blocking material and foil off the spectacle lens.

A disadvantage of this prior art can be seen particularly in that—as a consequence of the interposed pre-heating step in the hot water bath—the deblocking of a spectacle lens lasts for a relatively a long time, which is contrary to efficient use of this method in RX workshops. Moreover, this temperature-assisted method would be disadvantageous in connection with blocking methods in which use is made of non-thermoplastic blocking materials.

Finally, in the older German Patent Application 10 2009 048 590.2-14 of the same applicant a deblocking device of the "outside" type is described in which a high-pressure jet of pressure medium delivered by a nozzle is directed in the manner of CNC technology onto a predetermined point of incidence in the edge region between spectacle lens and block piece, namely through positional regulation of motor-driven movement axes, which produces a relative movement between the nozzle and blocked spectacle lens. The equipment outlay connected therewith is not, however, insignificant, so that this deblocking device is primarily suitable for larger RX workshops with a high level of automation. However, there is also a need in smaller RX workshops with a low level of automation for a device-assisted deblocking of spectacle lenses.

What is desired is a device of simplest possible construction for deblocking optical workpieces, particularly spectacle lenses, by which the optical workpieces can be deblocked as securely, free of damage and rapidly as possible.

SUMMARY OF THE INVENTION

According to one aspect of the invention a device for deblocking optical workpieces, particularly spectacle lenses, has a first movement device for rotation of a workpiece, which is blocked on a block piece, about a workpiece axis of rotation. It also has a nozzle for delivery of a high-pressure jet of pressure medium in a direction substantially transverse to the workpiece axis of rotation onto a point of incidence in an edge region between the block piece and workpiece and a second movement device for generating a relative movement between the nozzle and the workpiece. The second movement device has a nozzle guide section at which the nozzle is mounted and by which the nozzle is positionable with respect to the block piece under cam control in order to direct the high-pressure jet of pressure medium in defined manner onto the point of incidence.

Due to the fact that the high-pressure jet of pressure medium by contrast to the prior art defining the category no longer randomly impinges on the separating point between block piece and blocking material or the separating point between blocking material and workpiece, but as a consequence of the positionability of the nozzle with respect to the block piece can be targeted onto the respective separating point, it is possible to deblock the workpiece significantly more quickly, which renders the device according to the invention particularly suitable for use in RX workshops. In this regard, a rapid deblocking process can be beneficially operated with a relatively high pressure of the pressure medium without a risk of damage of the workpiece by the high-pressure jet of pressure medium, since through the selectively executable relative setting of nozzle and block piece or workpiece it is possible to avoid wiping of the high-pressure jet of pressure medium over the workpiece in a critical manner. Thus, it is possible to deblock workpieces, which are blocked in particular by adhesives, rapidly, safely and free of damage without requiring upstream soaking and/or softening processes and/or temperature-controlled pressure medium for the deblocking.

Moreover, through provision of a cam control for positioning the nozzle guide section of the second movement device—through mechanically positive measures—it is possible in terms of equipment in a particularly simple and readily reproducible way to optimally position the nozzle with respect to the edge region between block piece and workpiece for rapid and safe deblocking of the workpiece from the block piece, specifically to so set the nozzle at a defined spacing from and/or at an angle with respect to the desired point of incidence of the high-pressure jet of pressure medium that the high-pressure jet of pressure medium is incident on the point of incidence at a predetermined incidence angle. In this regard, CNC positionally regulated drives or the like—just as motors in general—are basically redundant, so that the device can be of very economic construction.

In this connection, the nozzle guide section can include a scanning arm which can be brought into operative engagement with an outer circumferential surface of the block piece so as to keep substantially constant, during the deblocking, a clear spacing between an outlet opening of the nozzle and the point of incidence of the high-pressure jet of the pressure medium in the edge region between block piece and workpiece regardless of the circumferential profile of the outer circumferential surface of the block piece and the rotational angle position of the block piece about the workpiece axis of rotation. If, for example, a plastics material block piece is used for blocking a spectacle lens, as disclosed in EP 2 093 018 A1 of the same applicant, and hereby incorporated by reference, which during the entire processing in the RX workshop remains at the spectacle lens, particularly even during an edge shaping step which serves the purpose of bringing the spectacle lens at the circumference to the spectacle frame shape and in which the block piece together with the spectacle lens is processed at the circumference with material removal, then the circumferential profile of the outer circumferential surface of the block piece can in correspondence with the spectacle frame shape be, for example, oval, drop-shaped or kidney-shaped, etc. Since the scanning arm of the nozzle guide section during rotation of the block piece travels by the first movement device precisely over this optionally worked block piece circumferential surface, the movement of the nozzle guide section thus being suitably cam-controlled by this engagement, the "free" length of the high-pressure jet of pressure medium or the transited path thereof between nozzle and point of incidence does not change, so that the pressure relationships in/at the point incidence of the high-pressure jet of pressure medium also do not change. Through suitable selection of the scanning arm length, which optionally can also be adjustable, it is thus possible to preset a nozzle spacing optimal for rapid and secure deblocking and to maintain this during the deblocking. Tests performed by the applicant with a conventional proprietary flat jet nozzle, which has a nozzle opening width of approximately 0.45 millimeters and a jet angle of approximately 25°, in which tests were carried out with a high-pressure jet of pressure medium formed by non-temperature-controlled mains water as pressure medium and with a water pressure between 100 and 140 bars, preferably 120 bars, have in this connection shown that the clear spacing between the nozzle and the predetermined point of incidence of the high-pressure jet of the pressure medium should lie between 15 millimeters and 40 millimeters, preferably at approximately 20 millimeters, in order to achieve a safe and rapid deblocking process. If the clear spacing is here too small, the blocking material is released only in the center of the fanned high-pressure jet; if, thereagainst, the clear spacing is selected to be too large, this substantially increases the deblocking time.

With respect to a particularly low-friction application of the scanning arm to the outer circumferential surface of the block piece it is preferred if the scanning arm has a scanning roller which is rotatably mounted thereon and which can be brought into operative engagement with the outer circumferential surface of the block piece.

In further pursuance of the concept of the invention the nozzle guide section can comprise a control plate which cooperates with at least one control cam in order to set an angle of incidence at which the high-pressure jet of pressure medium is incident on the point of incidence in the edge region between block piece and workpiece during the deblocking. Through this further cam control it is possible in simple manner to also definedly and repeatedly preset the angular orientation of the nozzle with respect to the block piece or workpiece for a rapid and safe deblocking so that the deblocking process can also be optimized in this respect. For example, the high-pressure jet can be inclined, with respect to a plane perpendicular to the workpiece axis of rotation, in the direction of the block piece, which enables deblocking even of those workpieces which have a smaller diameter than the block piece or, however, inclined away from the block piece, which during deblocking generates at the workpiece a force component which is directed away from the block piece and to that extent promotes separation of workpiece and block piece.

In the case of block pieces which have a clamping section for reception in a collet chuck of the first movement device and a definedly curved blocking surface, which faces away from the clamping section, for fastening of the working piece it is preferred in this connection if the at least one control cam has a control surface curved in accordance with the curvature of the blocking surface of the block piece. Thus, a relationship between the nozzle orientation and thus the beam orientation of the high-pressure water jet and the actual adhesion surface or retaining surface of the block piece, namely the blocking surface, is produced in simple manner. For example, it can be ensured that the high-pressure water jet is always incident on the point of incidence in tangential direction with respect to the blocking surface so that during the release process it can always penetrate to a maximum depth into the release gap, which forms, between the workpiece and block piece.

In one embodiment, the blocking surface of the block piece can be of spherical construction, whereas the control surface of the at least one control cam is arcuately curved, in which case the at least one control cam is so positionable with respect to the collet chuck that the spherical blocking surface of the block piece received in the collet chuck and the arcuately curved control surface of the at least one control cam are concentrically arranged with respect to a notional center point on the workpiece axis of rotation.

If use is made of different block pieces with differently curved blocking surfaces in order to provide, as far as possible, optimal blocking of differently shaped workpieces—as described in, for example, EP 2 011 604 A1 of the same applicant with reference to FIG. 8—which is hereby incorporated by reference, then advantageously a plurality of control cams, which are mounted on a common cam holder, with differently curved control surfaces can be provided, wherein the cam holder is constructed to be positionable with respect to the control plate of the nozzle guide section so that depending on the curvature of the blocking surface of the respectively clamped block piece a matching control cam is positionable opposite the control plate. The respective geometry of the block piece can thus correspondingly always ensure deblocking conditions which are as optimal as possible.

With respect to application or engagement of the control plate to or with the at least one control cam in a manner which is as low in friction as possible it is preferred if the control plate can be brought by way of two guide rollers, which are rotatably mounted thereon and the axes of rotation of which are spaced from one another, into operative connection with the at least one control cam. The control plate can thus advantageously roll or travel on the control cam like a carriage.

With respect to a capability of presetting for the nozzle direction as flexibly as possible it is additionally preferred if the nozzle guide section has a nozzle holder on which the nozzle is mounted and which is connected with the control plate to be angularly adjustable.

In an advantageous embodiment the second movement device can may have a first lever mechanism to which the nozzle guide section is pivotably coupled and by which the nozzle guide section is movable from a rest position to a working position and vice versa, which ensures good accessibility and loading, which is as free of obstruction as possible, of the deblocking device.

If the deblocking device has a protective hood, which is selectively movable from a closed position in which it closes a working space of the device to an open position in which it allows access to the working space and vice versa, then the first lever mechanism can, for simplest possible handling, be so constrainedly coupled with the protective hood that in the closed position of the protective hood the nozzle guide section is disposed in its working position, whereas in the open position of the protective hood the nozzle guide section is disposed in its rest position. In principle, a linkage, gear transmission or lever mechanism can be provided for that purpose. In a preferred embodiment which is as economic as possible, however, the first lever mechanism may be constrainedly coupled with the protective hood via a cable pull.

With regard to a simple capability of operation and operating safety which is as high as possible it is additionally preferred if a switch arrangement, by way of which an electrically driven high-pressure pump—in fluid connection with the nozzle—of the deblocking device is selectively activatable, is actuable by slight manual lowering of the protective hood from the closed position thereof against a spring force.

In an embodiment which is particularly simple in terms of hardware the first movement device comprises a spindle which at one end thereof carries the collet chuck for the block piece and at the other end thereof is operatively connected with a handwheel by way of which the spindle and thus the collet chuck are manually rotatable for the deblocking. The block piece can thus be rotated in problem-free manner about the workpiece axis of rotation, which usually accelerates the deblocking process by comparison with a deblocking process, which is in principle possible, with a block piece held to be secure against rotation. A motorized drive is also not needed for that purpose. Moreover, it is possible for the user of the deblocking device to selectively rotate the block piece into specific rotational angle positions or hold it therein in order to influence the deblocking process as desired.

It is further preferred if a withdrawal device with a suction head is provided, which for the deblocking can be acted on by a sub-atmospheric pressure in order to firmly suck against a second optically effective surface, which is remote from the block piece, of the workpiece so that a defined withdrawal force can be applied to the workpiece by the withdrawal device via the suction head. On the one hand, this is beneficial for a rapid deblocking process and on the other hand the workpiece during the deblocking is prevented from uncontrolled detaching or "flying off", which could lead to damage of the workpiece.

In a further more simple and economic embodiment the withdrawal device can comprise a manually actuable piston-cylinder arrangement, which is pneumatically connected with the suction head, for generating a sub-atmospheric pressure.

For the same reasons it is preferred if the withdrawal device has a second lever mechanism, by which the suction head is manually pivotable from a rest position to a suction position and vice versa, and at least one spring, which can be biased by pivoting of the suction head from the rest position thereof to the suction position so as to generate the withdrawal force.

Finally, in this connection the afore-mentioned piston-cylinder arrangement can be operatively connected with the second lever mechanism so that by the pivot movement of the second lever mechanism the piston-cylinder arrangement is also actuable in order to generate the sub-atmospheric pressure. Thus, withdrawal force and sub-atmospheric pressure can be produced in one movement in an ergonomically favorable manner.

BRIEF DESCRIPTION OF THE DRAWINGS

The invention is explained in more detail in the following on the basis of a preferred embodiment with reference to the accompanying, partly schematic drawings, wherein for simplification of the illustration and for the sake of better clarity subassemblies and components have in part also been omitted if not appearing necessary for an understanding of the invention. In the drawings, in part in different scales:

FIG. 3 shows a front view of the deblocking device according to FIG. 1, wherein the protective hood was entirely omitted and, of the sheet metal housing, merely a lower trough section is shown, FIG. 4 shows a plan view of the deblocking device according to FIG. 1 with a viewing direction from above in FIG. 3 and the simplifications of FIG. 3.

DETAILED DESCRIPTION OF THE EMBODIMENT

Figure 1:
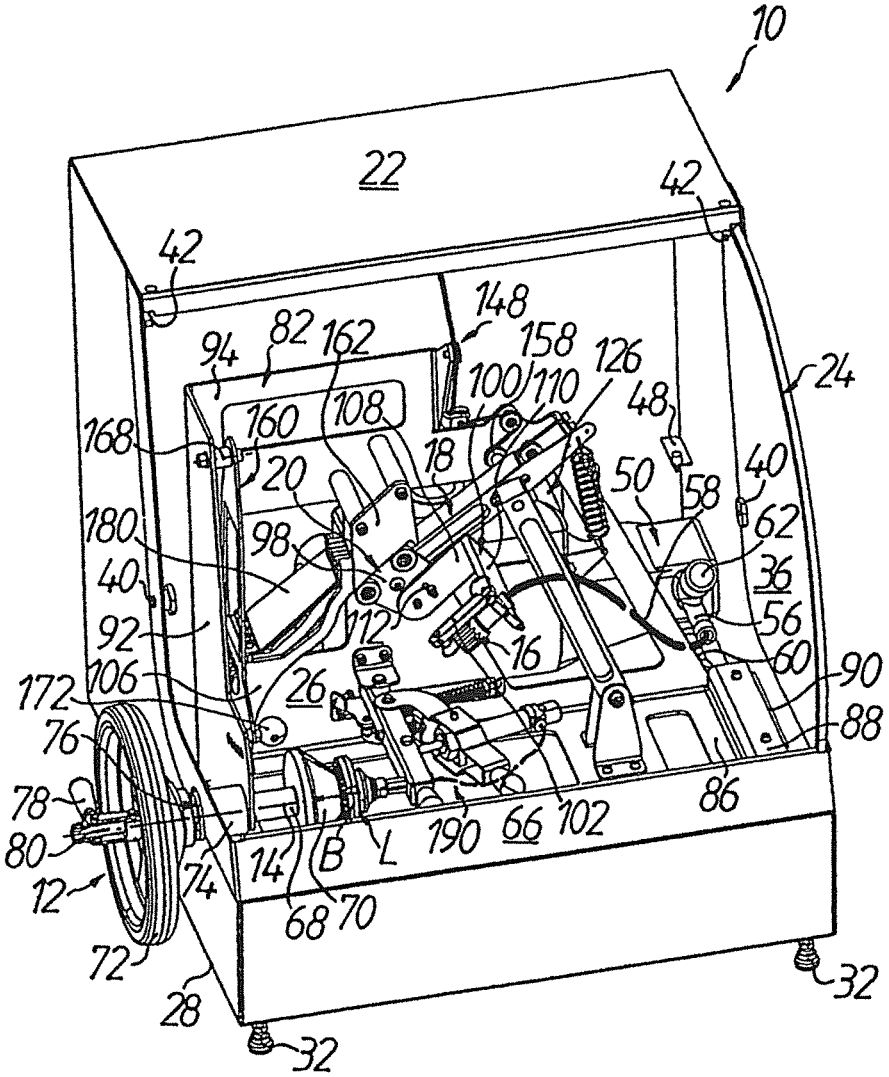
FIG. 1 shows a perspective view, obliquely from above and the front left, of a device according to the invention for deblocking spectacle lenses as optical workpieces, wherein a curved front wall and a left-hand side wall of a protective hood were omitted from the illustration so as to allow a free view into the interior of the deblocking device and wherein a nozzle guide section, which is pivotably coupled to a first lever mechanism, of the deblocking device is disposed in an upper rest position.

A device for deblocking spectacle lenses L as optical workpieces is denoted in the figures by 10. The deblocking device 10 comprises in general a first movement device 12 for rotation of a spectacle lens L, which is blocked on a block piece B, about a workpiece axis 14 of rotation, a nozzle 16 for delivery of a high-pressure jet H of pressure medium (see FIG. 6) in a direction substantially transverse to the workpiece axis 14 of rotation onto a point A of incidence in an edge region between block piece B and spectacle lens L, and a second movement device 18 for generating a relative movement between the nozzle 16 and the spectacle lens L. It is significant that the second movement device 18 has a nozzle guide section 20, at which the nozzle 16 is mounted and by which the nozzle 16 is positionable with respect to the block piece B under cam control in order to direct the high-pressure jet H of pressure medium in defined manner onto the point A of incidence, as will be described in more detail in the following.

Figure 2:
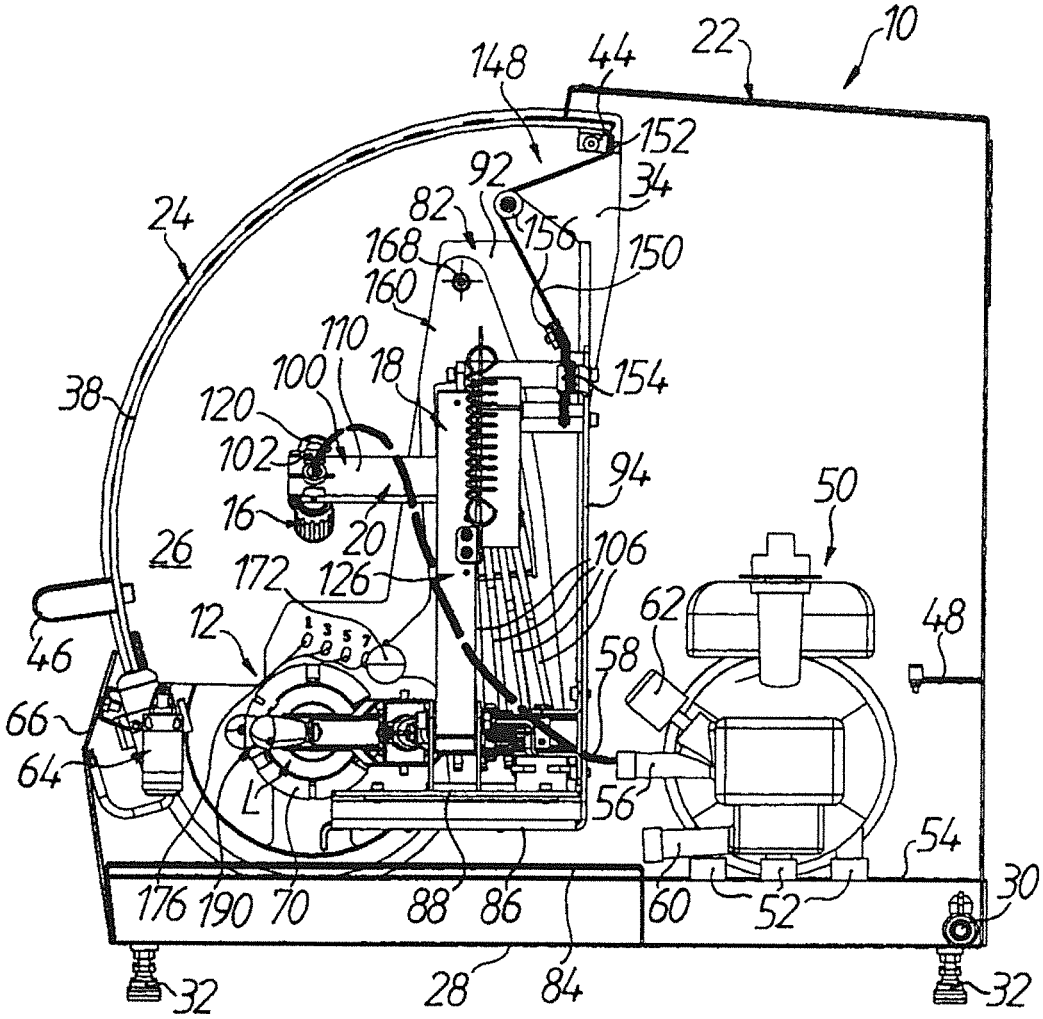
FIG. 2 shows a side view of the deblocking device according to FIG. 1 with a viewing direction from the right in FIG. 1, wherein the curved front wall and the left-hand side wall of the protective hood are illustrated, but for that purpose the right-hand side wall of the protective hood and parts of a sheet metal housing of the deblocking device were omitted so as to enable a free view into the interior of the deblocking device.

According to FIGS. 1 and 2 the deblocking device 10 comprises a welded sheet-metal housing 22 which together with a protective hood 24 bounds a working space 26 of the deblocking device 10. The sheet-metal housing 22 has a lower trough section 28 which serves at the same time as a reservoir and collecting basin for the mains water used for the deblocking. At its deepest point the trough section 28 is provided with a water drain valve 30 (FIG. 2) by way of which the trough section 28 can be emptied when required, if, for example, the water used is to be exchanged. For leveling of the blocking device 10 overall, provided at the four corners of the trough section 28 are adjustable leveling elements 32 by way of which the deblocking device 10 can be placed on a floor and brought into a horizontal position relative thereto.

The protective hood 24 is made of a transparent material in order to make possible for the user a free view into the working space 26 during the deblocking and has a left-hand and right-hand, substantially arcuate side wall 34 and 36 and a front wall 38 which is curved or, as seen in cross-section, arcuate. The side walls 34 and 36 respectively pivotably coupled to the sheet-metal housing 22 by way of a pivot bearing 40 are glued to the front wall 38 in such a manner that the side walls 34 and 36 project with respect to the pivot bearings 40 in radial direction a few millimeters beyond the curved front wall 38 (see FIG. 2). These projecting regions of the side walls 34 and 36 form guide profiles by way of which the protective hood 24 is additionally guided at both sides in associated opened portions 42 (cf. FIG. 1) in an upper region of the sheet-metal housing 22. The rear edge of the front wall 38 is additionally reinforced by a sheet-metal profile strip 44 which is screw-connected and glued to the protective hood 24. Mounted on the front wall 38 of the protective hood 28 in a lower, front region and substantially centrally is a handle 46 by which the protective hood 24 is selectively pivotable, i.e. about the pivot bearings 40, from a closed position, in which it closes the working space 26 of the deblocking device 10, to an open position, in which it allows access to the working space 26, and vice versa. Finally, abutments 48 are mounted in rear, lower corner regions of the sheet upper metal housing 22 on both sides by rubber cushions which limit the pivot movement of the protective hood 24 into the open position.

An electrically driven high-pressure pump 50 is arranged in a rear region of the sheet-metal housing 22 on the right in FIG. 1. The high-pressure pump 50 is mounted by way of a plurality of vibration insulators 52 (see FIG. 2) on a mounting plate 54 which in turn is mounted on the sheet-metal housing 22 above the trough section 28. The high-pressure pump 50 comprises a pressure connection 56, which is hydraulically connected with the nozzle 16 by way of a resilient high-pressure hose 58 (indicated only in dashed lines), and a suction connection 60, which is in fluid connection by way of a hose length, which is not illustrated and which reaches to the base of the trough section 28, with the trough section 28 so that the high-pressure pump 50 can suck water out of the trough section 28. In this way it is possible to constantly operate with the same water in a closed circuit. In this regard, a filter (not shown) in the hose length prevents possible dirt particles from being able to be sucked up and damage to the spectacle lens L and/or the deblocking device 10*b* being caused. The pressure of the water delivered by way of the pressure connection 56 can be set by a pressure regulator 62.

Provided for activation of the high-pressure pump 50 in fluid connection with the nozzle 16 is a switch arrangement 64 which according to FIG. 2 is mounted from within at a front plate 66 of the sheet-metal housing 72. The switch arrangement 64 is actuable by slight manual lowering of the protective hood 24 from the closed position thereof against spring force. More precisely, the switch arrangement 64 has two safety switches which are connected in series and which co-operate with a lower edge of the front wall 38 of the protective hood 24 as follows: In the case of a closing movement of the protective hood 24 the lower edge of the protective hood 24 initially comes into contact in the closed position thereof with two compression springs (not illustrated), which are mounted in the region of the switch arrangement 64 at the sheet-metal housing 22 and which space the lower edge from the switch arrangement 64. If the protective hood 24 is pressed further down out of this pivot position by way of the handle 46 by the user with a force exceeding the spring force of the compressions springs then the compression springs are compressed and the lower edge of the protective hood 24 comes—optionally indirectly by way of switching fingers—into actuation—effective engagement with the safety switches of the switch arrangement 64, in which case the safety switches are closed. If the user relieves the handle 46 of pressure, then the compression springs urge the protective hood 24 upwardly again and the safety switches of the switch arrangement 64 are opened. In this way it is ensured that the high-pressure pump 50 can be activated only when the protective hood 24 is closed and for this purpose a user intervention (further pressing down of the protective hood 24 by way of the handle 46 against spring force) is additionally needed; as soon as the handle 46 is released by the user, the high-pressure pump 50 goes off.

Figure 7:
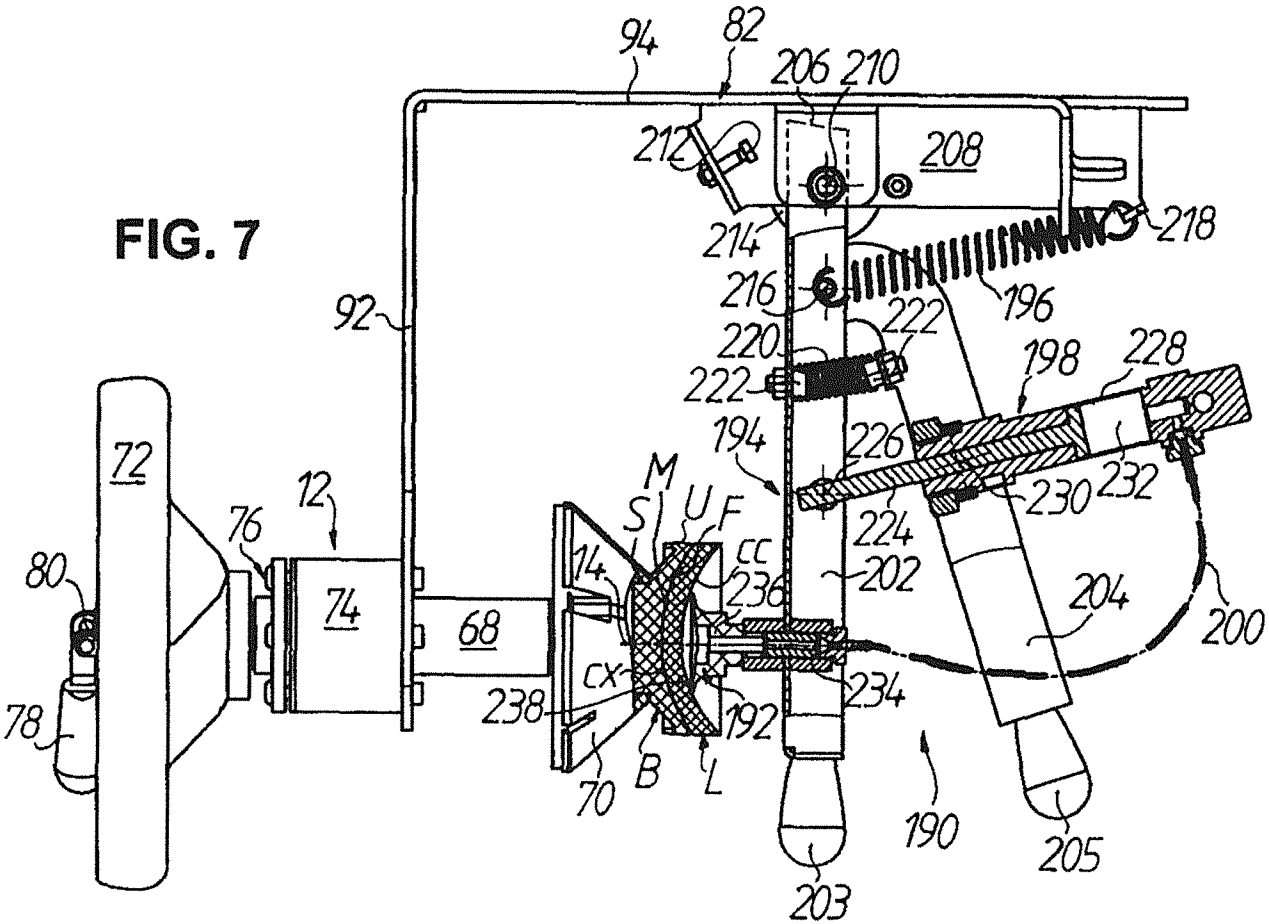
FIG. 7 shows a view, which is only partly sectioned, of the deblocking device according to FIG. 1 in correspondence with the section line VII-VII in FIG. 3, for illustration of details of a withdrawal device of the deblocking device.

Further details of the first movement device 12 can be inferred from, in particular FIGS. 3, 4 and 7. According to those, the first movement device has a spindle 68 which at one end—protruding into the working space 26—thereof carries a collet chuck 70 for the block piece B and at the other end—which is outer with respect to the sheet-metal housing 22—thereof is operatively connected with a handwheel 72 by way of which the spindle 68 and thus the collet chuck is manually rotatable about the workpiece axis 14 of rotation for the deblocking. The spindle 68 is rotatably mounted via suitable bearings (not illustrated), for example plastics material plain bearings, in a spindle housing 74 which at 76 (see FIG. 1) is fixedly screw-connected with a side wall of the sheet-metal housing 22. The collet chuck 70 is preferably of such a kind as to be capable of holding the block piece B in a manner, which is known per se, by radially acting clamping forces at a substantially cylindrical clamping section S of the block piece B (see FIG. 7). Provided in the center of the handwheel 72 is a clamping lever 78 which is operatively connected with the collet chuck 70 by way of a pull rod 80 extending through the spindle 68, so that the collet chuck 70 can be selectively opened or, for clamping the block piece B, closed by the clamping lever 78.

Figure 5:
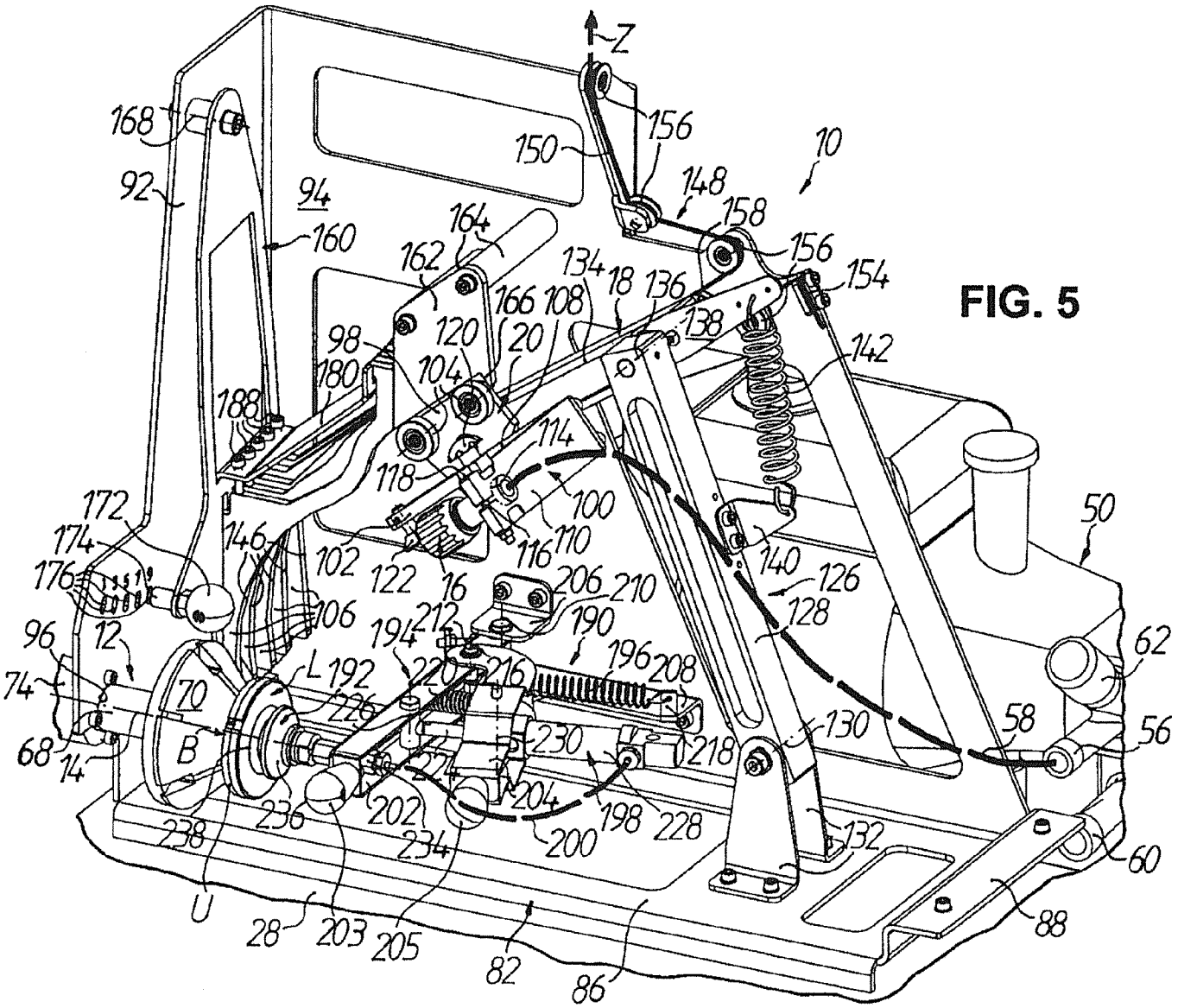
FIG. 5 shows a perspective view, which by comparison with FIG. 1 is of significantly enlarged scale and is partly broken away, of the deblocking device according to FIG. 1 from above and the front right with the simplifications of FIGS. 3 and 4, for better illustration of functionally significant subassemblies of the deblocking device.

The further mechanical subassemblies of the deblocking device 10 are carried by a multiply bent base body 82 which is punched (or cut by laser) from sheet metal and which is arranged in the working space 26 above a water-permeable apertured plate 84 seated in the trough section 28 of the sheet-metal housing 22 and—according to FIG. 2—flanged at the front and the back. The base body 82 has a base section 86 with which a flange section 88 is connected on the side on the right in FIGS. 1 and 3 to 5. The flange section 88 of the base body 82 lies on a sheet-metal bracket 90 (able to be seen only partly in FIG. 1), which is mounted on a side wall on the sheet-metal housing 22 and screw-connected therewith. Connected with the base body 82 on the side at the left in FIGS. 1 and 3 to 5 is a side wall 92 which according to, in particular, FIGS. 1, 4, 5 and 7 forms a right angle with a rear wall 94 of the base body 82. As, in particular, FIG. 5 shows, the side wall 92 has at the front and below a cut-out 96 penetrated by the spindle 68. The side wall 92 is screw-connected in the region of this cut-out 96 with the spindle housing 74, which for its part is fastened to the sheet-metal housing 22 by the screw connection 76. The base body 82 is thus mounted on the right (at the flange section 88) and the left (at the cut-out 96) with respect to the sheet-metal housing 22 and fastened via a few screws, which facilitates access and demounting in the case of servicing.

The second movement device 18 of the deblocking device 10 shall now be described in more detail with reference to, in particular, FIGS. 1, 5 and 6. The core of the second movement device 18 is the nozzle guide section 20, which generally has a control plate 98, a nozzle holder 100 and a scanning arm 102. The control plate 98 can be brought into operative connection with a or at least one control cam 106, as will be explained in more detail, by way of two guide rollers 104 which are rotatably mounted on the plate and the parallel axes of rotation of which are spaced from one another.

The nozzle holder 100 has a carrier plate 108 and a clamping member 110, which form a right angle and are fixedly connected together. The carrier plate 108 extending substantially parallel to the control plate 98 is, according to FIG. 1, fastened to the control plate 98 with the help of two screws. Whereas the lower screw, on the left in FIG. 1, passes through a bore in the control plate 98, the other, upper screw, on the right in FIG. 1, extends through an arcuately extending oblong hole 112 in the carrier plate 108 so that the nozzle holder 100 is connected with the control plate 98 to be angularly adjustable.

According to FIG. 5 the clamping member 110 has a receiving bore 114 for the nozzle 16 and is slotted, going out from the receiving bore 114, up to its free end remote from the carrier plate 108 (slot 116). A screw 118 engages through a passage bore, which is provided in the region of the slot 116, in the clamping member 110 so that the nozzle 16 can be indirectly clamped in the receiving bore 114 by way of the screw 118 so as to exchangeably mount the nozzle 16 at the nozzle holder 100.

The scanning arm 102 is held by a clamping screw 120 in an associated cut-out of the clamping member 110 in an upper region, which is at the front in FIG. 5, of the clamping member 110 and above the receiving bore 114 for the nozzle 16. Rotatedly mounted on the scanning arm 102 at the end of the scanning arm 102 remote from the clamping member 110 is a scanning roller 122 by way of which the scanning arm 102 can be brought into operative engagement with an outer circumferential surface U of the block piece B, as shown in FIG. 6. Through this operative engagement of the scanning arm 102 with the outer circumferential surface U of the block piece B it is possible during unblocking to keep substantially constant a clear spacing a between an outlet opening 124 of the nozzle 16 and the point A of incidence of the high-pressure jet H of pressure medium in the edge region between the block piece B and spectacle lens L independently of the circumferential profile of the circumferential surface U of the block piece B and the rotational angle position of the block piece B about the workpiece axis 14 of rotation. In other words, the scanning roller 122 and scanning arm 102 serve during the deblocking process for supporting the nozzle guide section 20 at the outer circumferential surface U of the block piece B in the manner of a cam control and thus ensure that the position of the nozzle 16 is always matched to the outer contour of the block piece B and the nozzle 16 in that case has an optimum spacing from the adhesion gap between block piece B and spectacle lens L.

In addition, the control plate 98 of the nozzle guide section 20 co-operates with the (at least one) control cam 106 in order to set an angle α of incidence (see FIG. 6) at which the high-pressure jet H of pressure medium is, during deblocking, incident on the point A of incidence in the edge region between block piece B and spectacle lens L, as will be described in more detail in the following.

In that regard, the second movement device 18 has a first lever mechanism 126 with which the nozzle guide section 20 is pivotably connected and by which the nozzle guide section 20 is movable from a rest position (FIGS. 1 to 5) to a working position (FIG. 6) and vice versa. The first lever mechanism 126 has, according to, in particular, FIGS. 5 and 6, a guide arm 128 which is mounted at two angle plates 132 to be pivotable about a pivot axis 130, the plates for their part being screw-connected with the base section 86 of the base body 82. In addition, the first lever mechanism 126 has a support arm 134 which is pivotably connected with the guide arm 128, at the end of the guide arm 128 remote from the angle plates 132, so that the support arm 134 is pivotable with respect to the guide arm 128 about a further pivot axis 136 parallel with the first pivot axis 130. A lever projection 138 is fixedly connected with the support arm 134 in the region of a pivot axis 136, while a plate bracket 140 is fastened substantially centrally to the guide arm 128. A tension spring 142 is stressed between the free ends of the lever projection 138 and the plate bracket 140 and exerts on the support arm 134 a rotary moment which endeavors to pivot the support arm 134 with respect to the guide arm 128 in counter-clockwise sense in FIGS. 5 and 6 about the pivot axis 136. Finally, the control plate 98 of the nozzle guide section 20 is pivotably coupled to the end of the support arm 134 remote from the pivot axis 136 so that the control plate 98 is pivotable with respect to the support arm 134 about a third pivot axis 144 (concealed in FIG. 5 by the clamping screw 120), which extends parallel to the two other pivot axes 130, 136. Ball-mounted shafts (not shown in more detail) can be employed at the pivot axes 130, 136, 144—just as at the guide rollers 104 and the scanning roller 122—in order to make the articulation formed by the first lever mechanism 126 as easy running as possible.

To that extent it is apparent that in the working position (FIG. 6) of the nozzle guide section 20 the same is supported by its weight, the weight of the nozzle 16 and a part of the weight of the first lever mechanism 126 by way of the scanning arm 102 and the scanning roller 122 at the outer circumferential surface U of the block piece B, wherein the spacing a of the nozzle 16 from the point A of incidence is set under cam control (outer circumferential surface U of the block piece B, the circumferential profile of which can optionally differ from a circular form). In a given case an auxiliary weight (not illustrated) can be additionally provided in order to avoid, even in the case of very high water pressures, the nozzle 16 together with the components connected therewith being forced away from the block piece B by the high-pressure jet H of pressure medium. At the same time, the tension spring 142 pulls, via the lever projection 138 and the support arm 134, the control plate 98, which is pivotably connected with the support min 134 by way of the pivot axis 144, of the nozzle guide section 20 by both guide rollers 104 against the control cam 106. When the nozzle guide section 20 is in a given case raised or lowered by way the scanning arm 102 the two guide rollers 104 roll on the control cam 106 and the angular position (angle α) of the nozzle 16 can therefore change under cam control with respect to the point A of incidence only as a function of the geometry of the control cam 106.

In the illustrated embodiment the blocking surface F, which is remote from the clamping section S of the block piece B, of the block piece B at which the spectacle lens L is blocked, i.e. fastened, by a blocking material M has a defined curvature, wherein the (at least one) control cam 106 has a control surface 146 curved in accordance with the curvature of the blocking surface F. More precisely, as shown in FIG. 6 the blocking surface F of the block piece B is formed to be spherical (radius r of the blocking surface F), while the control surface 146 of the control cam 106 is arcuately curved (radius R of the control surface 146). The control cam 106 is so positioned with respect to the collet chuck 70 that the spherical blocking surface F of the block piece B received in the collet chuck 70 and the arcuately curved control surface 146 of the control cam 106 are arranged concentrically with respect to a notional center point P on the workpiece axis 14 of rotation. In this manner it is ensured that the high-pressure jet H of pressure medium always impinges with the same angle of incidence with respect to the blocking surface F at the point A of incidence. In this regard, the nozzle holder 100 can be so angularly preset (oblong hole 112), thus for example with respect to the control plate 98, that the high-pressure jet H of the pressure medium is always incident on the point A of incidence tangentially to the blocking surface F.

Figure 6:
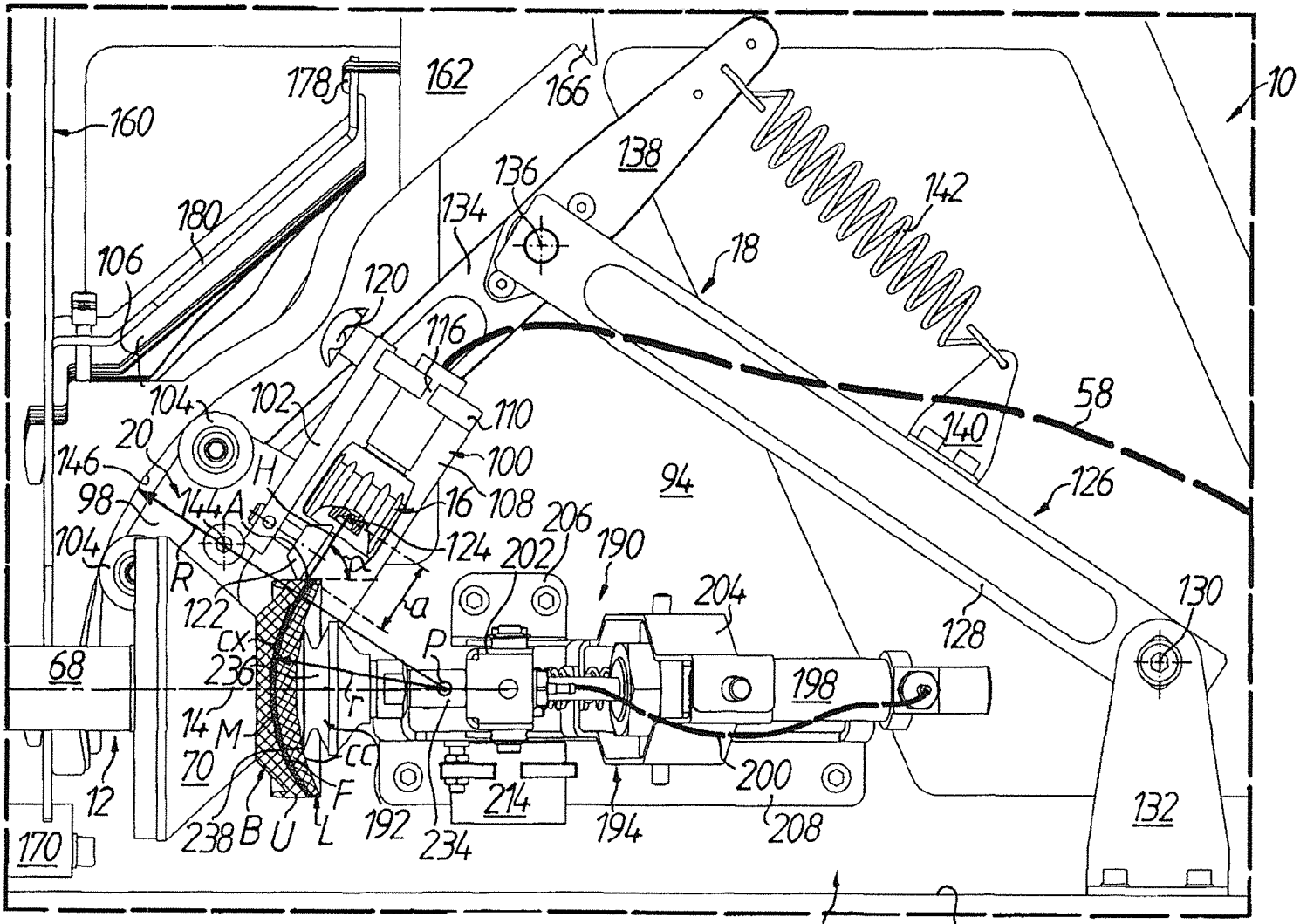
FIG. 6 shows a front view of the deblocking device according to FIG. 1 in correspondence with the detail VI in FIG. 3, wherein, by contrast with FIG. 3, the nozzle guide section of the deblocking device is disposed in a lower working position.

If, moreover, a layer of blocking material M is present between the spectacle lens L and the block piece B, as shown in FIG. 6, the predetermined point A of incidence of the high-pressure jet H of pressure medium can then in principle also lie at the separating point between spectacle lens L and blocking material M. However, it is preferred if the predetermined point A of incidence of the high-pressure jet H of pressure medium lies in the boundary region between block piece B and blocking material M so that the blocking material M initially remains as protection on the spectacle lens and can be removed from the spectacle lens by hand at a suitable time.

The first lever mechanism 126 is, in addition, constrainedly coupled with the protective hood 24 and, in particular, in such a manner that in the closed position of the protective hood 24—different from that illustrated in FIGS. 1 and 2—the nozzle guide section 20 is actually disposed in its lowered working position (cf. FIG. 6), whereas in the open position of the protective hood 24 the nozzle guide section 20 is disposed in its raised rest position (see, for example, FIG. 3). In the illustrated embodiment this constrained coupling of the movements of protective hood 25 and lever mechanism 26 is realized by a pull cable 148. The pull cable 148 has a steel cable 150, one end of which according to FIG. 2 is fixed in the middle of the sheet-metal profile strip 44 of the protective hood 24 at a first cable clamping mechanism 152. The other end of the steel cable 150 is fastened to the rear wall 94 of the base body 82 by way of a second cable clamping mechanism 154, as can be seen in FIGS. 2 and 5. Therebetween, the steel cable 150 runs over a total of four deflecting rollers 146 rotatably mounted at the rear wall 94 of the base body 82 as shown in FIG. 5. A cable pull roller 158 is rotatably mounted on the rear side of the support arm 134 at the pivot axis 136, only a part of the roller being able to be seen in FIG. 5. The cable pull roller 158 is hung in the steel cable 150 between the deflecting rollers 156 on the right in FIGS. 1 and 5 so that pulling of the steel cable 150 via the pivoted-open protective hood 24 (corresponding with the arrow Z in FIG. 5) raises the first lever mechanism 126, while closing of the protective hood 24 enables lowering of the first lever mechanism 126 under its own weight.

In addition, in the illustrated embodiment a cam holder 160 is provided at which a plurality—here five—of control cams 106 with differently curved control surfaces 146 is mounted. The cam holder 160 is constructed to be positionable with respect to the control plate 98 of the nozzle guide section 20 so that as a function of the curvature of the blocking surface F of the respective block piece B clamped in the collet chuck 70 a matching control cam 106 can be placed opposite the control plate 98. In this regard, initially a basic cam 162 is fixedly screw-connected with the rear wall 94 of the base body 82 with the help of spacers 164. The basic cam 162 has an end abutment 166 for the control plate 98, which in the rest position of the nozzle guide section 20 remains "parked" by its guide rollers 104 on the basic cam 162.

Between the side wall 92 of the base body 82 and the basic cam 162 the cam holder 160, which is punched out and bent from a sheet-metal plate, is mounted on the side wall 92 to be pivotable about a pivot axis 168. The cam holder 160 is guided at its end, which is lower in FIGS. 3 and 6, in a guide block 170, which is slotted from above and which permits unhindered pivoting of the cam holder 160 about the pivot axis 168, but the cam holder 160 is fixed in lateral direction, i.e. to the right and left in FIGS. 3 and 6. The guide block 170 itself is, according to FIG. 3, fixedly screw-connected with the side wall 92 of the base body 82.

Provided in a lower region, which is at the front in FIGS. 1 and 5, of the cam holder 160 is a spherical detent knob 172 with spring actuation (omitted in FIG. 6 for the sake of better clarity), the detent pin 172 of which depending on selection engages in one of five numbered bores 176 in the side wall 92 of the base body 82. Different control cams 106 can thus be preselected by pulling the detent knob 172 against spring force, in which case the detent pin 174 comes out of engagement from the respective bore 176, pivoting the cam holder 160 about the pivot axis 168 and subsequently releasing the detent knob 172, in which case the detent pin 174 comes into engagement with the bore 176 opposite thereto. Preselection means that the respectively desired control cam 106 is—similarly to a set of points—disposed opposite the basic cam 162 by pivoting of the cam holder 160 about the pivot axis 168 so that this control cam 106 forms together with the basic cam 162 a common path for the guide rollers 104 at the control plate 98. The numbers (1, 3, 5, 7, 9) engraved on the side wall 92 in this regard refer to the different curvatures of the blocking surfaces F of the block pieces B, which are used, in dioptric values. The different curvatures of the control surfaces 146 of the selectable control cams 106 and the different curvatures of the blocking surfaces F of the block pieces which are used are—as already described further above with reference to FIG. 6 (radii R, r; center point P)—in direct relationship to one another so as to ensure that the nozzle 16 is optimally spaced and oriented with respect to the block piece B regardless of the outer diameter of the outer circumferential surface U of the block piece B.

Figure 8:
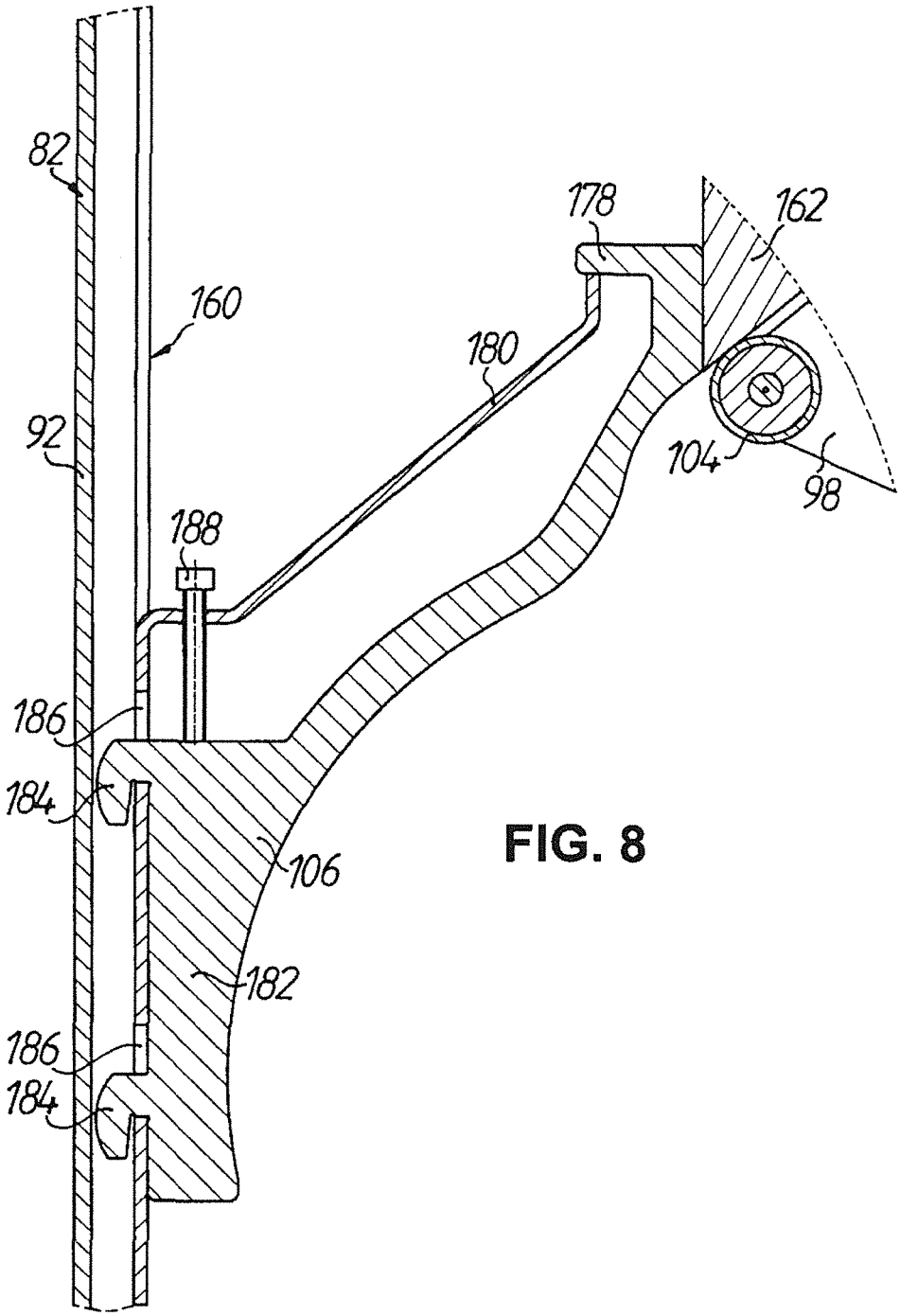
FIG. 8 shows a sectional view, which is significantly enlarged in scale and which is broken away, of the deblocking device according to FIG. 1 in correspondence with the section line VIII-VIII in FIG. 4, for illustration of details of a control cam holder of the deblocking device.

From FIG. 8 further details can be inferred with regard to how the control cams 106, which according to FIG. 2 are arranged in fan-like manner in or at the cam holder 160, are fastened to the cam holder 160. According to that, each control cam 106, which is cut from a sheet-metal plate, has at its upper end, which is on the right in FIG. 8, a projection 178 which protrudes in the direction of the side wall 92 and which is suspended in an associated cut-out in an upper edge, which is formed to be comb-like, of a holding section 180 of the cam holder 160. Each control cam 106 has at a lower base section 182, which is on the left in FIG. 8, two hook-shaped projections 184 which are spaced-apart in height and protrude in the direction of the side wall 92 and which—similarly to a shelf board support—can be suspended in respectively associated cut-outs 106 in the cam holder 160. Provided for securing the exchangeable control cams 106 are clamping screws 188 which are screwed into threaded bores in the holding section 180 of the cam holder 160 and can be readily seen to prevent the respective control cam 106 from being able to come out of engagement with the cam holder 160.

Whereas the spectacle lens L according to FIGS. 6 and 7 is block-mounted by its first optically effective surface cx by the blocking material M at the blocking surface F of the block piece B, the second optically effective surface cc of the block-mounted spectacle lens L lies in the deblocking device 10 opposite a withdrawal device 190 with a suction head 192. The suction head 192 for the deblocking can be acted on by a sub-atmospheric pressure in order to firmly suck against the second optically effective surface cc so that a withdrawal force can be applied to the spectacle lens L by the withdrawal device 190 via the suction head 192.

As will be described in more detail in the following with reference to FIG. 7, the withdrawal device 190 has a second lever mechanism 194, by which the suction head 192 is manually pivotable from a rest position to a suction position (always shown in the figures) and vice versa, and has at least one spring 196 which through pivoting of the suction head from the rest position thereof to the suction position can be stressed in order to generate the withdrawal force. Moreover, the second lever mechanism 194 is operatively connected with a piston-cylinder arrangement 198 of the withdrawal device 190, which is pneumatically connected with the suction head 192 by way of a pneumatic hose 200—indicated in dashed lines in the figures—so that the piston-cylinder arrangement 198 is also manually actuable by the pivot movement of the second lever mechanism 194 in order to generate a sub-atmospheric pressure in the suction head 192.

The second lever mechanism 194 comprises a first lever 202 and a second lever 204, which are respectively provided at the free ends thereof with a handle 203 or 205 (taken off in FIG. 6). The first lever 202 is articulated by its end, which is remote from the handle 203, between two angle plates 206, 208 so as to be pivotable about a pivot axis 210. The angle plates 206, 208 are in turn fixedly screw-connected with the rear wall 94 in a lower, middle region of the back wall 94 of the base body 82. Mounted on the angle plate 208, which is lower in FIG. 5, is an abutment 212 which, according to FIG. 7, is screw-adjustable and which limits a pivot movement of the first lever 202 in anti-clockwise sense in FIG. 7 about the pivot axis 210. Moreover, arranged below the angle plate 208 is a movement damper 214 (see, also, FIG. 6) which delays movement of the lever mechanism 194 on detaching of the spectacle lens L from the block piece B so as to minimize the risk that when the lever mechanism 194 pivots away from the block piece B the deblocked spectacle lens L detaches from the suction head 192 and as a consequence thereof is damaged.

The second lever 204 is articulated to the first lever 202 at a suitable spacing from the pivot axis 210 in the direction of the handle 203 so as to be pivotable about a further pivot axis 216. Arranged between the pivot axis 216 and a fastening strap 218, which is bent over from the angle plate 208, is the spring 196 which is constructed as a tension spring and which is thus capable of exerting on the first lever 202 a torque about the pivot axis 210 in anti-clockwise sense in FIG. 7, but in that case leaves the second lever 204 free of force.

Moreover, a compression spring 220 is according to FIG. 7 clamped in place between the levers 202, 204 at a suitable spacing from the pivot axis 216 in the direction of the handles 203, 205 and is held at the respective levers 202, 204 by a spring mount 222. The piston-cylinder arrangement 198 is arranged between the levers 202, 204 at a suitable spacing from the spring mounts 222 in the direction of the handles 203, 205, wherein a piston rod 224 of the piston-cylinder arrangement 198 is pivotably coupled to the first lever 202 to be pivotable about a pivot axis 226, whereas a cylinder housing 228 of the piston-cylinder arrangement 198 is pivotably coupled to the second lever 204 to be pivotable about a further pivot axis 230. The compression spring 220 endeavors to urge the levers 202, 204 apart, but is prevented therefrom by the piston-cylinder arrangement 198 in the extended state thereof (shown in FIG. 7). Accordingly, in order to achieve the retracted state of the piston-cylinder arrangement 198 the compression spring 220 has to be overcome. It is apparent that if the two levers 202, 204 are pushed together against the force of the compression spring 220, the piston-cylinder arrangement 198 is pushed together and that if the second lever 204 is released from this position the force of the compression spring 220 produces urging apart of the levers 202, 204, as a consequence of which the piston-cylinder arrangement 198 is pulled out and a sub-atmospheric pressure arises in the pressure chamber 232 thereof, which pressure is applied by way of the pneumatic hose 200 to the suction head 192.

Finally, the suction head 192 is mounted on the first lever 2020 between the pivot axis 226 and the handle 203. More precisely, the suction head 192 has a suction member 234, which is fixedly mounted on the first lever 202 and is connected with the piston-cylinder arrangement 198 by way of the pneumatic hose 200, and a resilient sucker 236, which is optionally constructed like a bellows, with a sealing lip 238 which can be brought into sealing contact with the second optically effective surface cc of the spectacle lens L in order to firmly suck the sucker 236 against the spectacle lens L.

It will be apparent that the user can pivot the second lever mechanism 194 overall in clockwise sense in FIG. 7 about the pivot axis 210 by application of a force to the handle 205 of the second lever 204. In that case, the tension spring 196 is stressed, but the compression spring 220 as a consequence of its firmer design is still not compressed. As soon as the suction head 192 is now pressed by the sealing lip 238 of its sucker 236 against the spectacle lens L the compression spring 220 and the piston-cylinder arrangement 198 are also compressed, wherein the air present in the pressure chamber 232 is displaced away under the sealing lip 238 by way of the pneumatic hose 200 and the suction head 192. If the user now "guides" the handle 205 "back" with a smaller force, in which case the second lever 204 as a consequence of the force of the compression spring 220 pivots with respect to the first lever 202 in FIG. 7 in anti-clockwise sense about the pivot axis 216 and the first lever 202 remains in its position, the piston-cylinder arrangement 198 is extended and as a consequence of the sub-atmospheric pressure that has arisen in the pressure chamber 232 the suction head 192 firmly sucks against the spectacle lens L. The user can now entirely release the second lever mechanism 194, whereupon the withdrawal device 190 as a consequence of the spring force of the biased tension spring 196 applies a defined withdrawal force to the spectacle lens L by way of the suction head 192.

A deblocking process as considered overall is illustrated as follows: Initially the protective hood 24 of the deblocking device 10 is opened by way of the handle 46 so that the user gains access to the working space 26. The clamping lever 78 at the handwheel 72 now has to be detached, whereupon the collet chuck 70 opens. As a consequence, a block piece B with spectacle lens L block-mounted thereon is placed in position and the collet chuck 70 closed by the clamping lever 78 so as to clamp the block piece B at its clamping section S. In correspondence with the geometry of the blocking surface F of the block piece B the associated control cam 106 is now to be preselected (withdrawal of the detent knob 172, appropriate pivoting of the cam holder 160, renewed detenting of the detent pin 174 in the desired pivot position of the cam holder 160). As a consequence, the lever mechanism 194 of the withdrawal device 190 is to be pivoted, as previously described, in order for the sucker 236 to firmly suck against the spectacle lens L, in which case not only a vacuum is produced (piston-cylinder arrangement 198, compression spring 220), but also a defined withdrawal force is generated (tension spring 196). The protective hood 24 is now to be closed, wherein the lever mechanism 126 of the second movement device 18 is lowered by way of the cable pull 148 and the nozzle guide section 20 rolls out of its parked position at the basic cam 162 by the guide rollers 104, which are provided at the control plate 98, along the preselected control cam 106 into its working position in which the scanning roller 122 at the scanning arm 102 of the nozzle guide section 20 comes into contact with the outer circumferential surface U of the block piece B. As soon as the protective hood 24 is completely closed and pressed down again by way of the handle 46, the high-pressure pump 50 switches on (switch arrangement 64), whereupon the nozzle 16 delivers the high-pressure jet H of pressure medium, while the user slowly rotates the handwheel 72. In this regard, the nozzle is, by virtue of the "doubled" cam control of the nozzle guide section 20 (control plate 98 with guide rollers 104 / control surface 146 of the control cam 106 or scanning arm 102 with scanning roller 122 / outer circumferential surface U of the block piece B), not only definedly spaced (clear spacing a) with respect to the point A of incidence of the high-pressure jet H of pressure medium, but also definedly adjusted (angle $\alpha$). The detaching of the spectacle lens L from the block piece B can be seen by the user by looking through the protective hood 24 into the working space 26 in that the lever mechanism 194 of the withdrawal device 190 pivots back to the right in FIG. 1. The user can now relieve the protective hood 24 of load, whereupon the high-pressure pump 50 is switched off. After pivoting up of the protective hood 24, in which case the nozzle guide section 20 is raised again via the cable pull 148, the block piece B and spectacle lens L can finally be removed, for which purpose the collet chuck 70 is to be opened by way of the clamping lever 78 and in a given case the two levers 202, 204 are to be moved towards one another. A further blocked spectacle lens L can now be deblocked in analogous manner.

For the sake of completeness it may finally be mentioned that the blocking material M can be, for example, an ultraviolet-light hardenable adhesive mixture such as described in WO 2009/003660 A1 which is incorporated herein by reference. The block piece B illustrated here is made from a plastic material and is the subject of WO 2009/106296 A1 as well as of the older German Patent Application 10 2008 051 833.6, which are hereby incorporated by reference with respect to the further structure and functions of the block piece B. Finally, with respect to a suitable blocking (block-mounting) method and a suitable blocking (block-mounting) device reference is made to WO 2009/135689 A1 which is hereby incorporated by reference.

A device for deblocking optical workpieces is disclosed, which has a first movement device for rotation of a workpiece, which is blocked on a block piece, about a workpiece axis of rotation, a nozzle for delivery of a high-pressure jet of pressure medium in a direction substantially transverse to the workpiece axis of rotation onto a point of incidence in an edge region between the block piece and workpiece, as well as a second movement device for generating a relative movement between the nozzle and the workpiece. In order that the workpieces can be deblocked as safely, free of damage and quickly as possible, the second movement device has a nozzle guide section at which the nozzle is mounted and by which the nozzle is positionable with respect to the block piece under cam control in order to direct the high-pressure jet of pressure medium in defined manner onto the point of incidence.

The invention claimed is:

1. A system including a device for deblocking an optical workpiece, particularly a spectacle lens, from a block piece for holding the workpiece, comprising:

a block piece and workpiece assembly, a first movement device for rotating the block piece and workpiece assembly about a workpiece axis of rotation via the block piece, wherein the workpiece is blocked on a defined curved blocking surface of the block piece, which also has an outer circumferential surface, a nozzle with an outlet opening for delivery of a high-pressure jet of a pressure medium via the outlet opening in a direction substantially transverse to the workpiece axis of rotation onto a point of incidence in an edge region between the block piece and the workpiece, and a second movement device for generating a relative movement between the nozzle and the workpiece, wherein the second movement device has a nozzle guide section on which the nozzle is mounted and by which the nozzle is positionable with respect to the block piece under mechanically positive cam control depending on one of the geometry of the outer circumferential surface of the block piece and the curvature of the blocking surface of the block piece in order to direct the high-pressure jet of pressure medium in defined manner onto the point of incidence, constructed such that during deblocking a substantially constant clear spacing is maintained between the outlet opening of the nozzle and the point of incidence and/or the high-pressure jet of pressure medium is set to be incident on the point of incidence at a predetermined incidence angle.

2. A system according to claim 1, characterized in that the nozzle guide section comprises a scanning arm which can be brought into operative engagement with an outer circumferential surface of the block piece in order to maintain a substantially constant clear spacing during deblocking between an outlet opening of the nozzle and the point of incidence of the high-pressure jet of the pressure medium in the edge region between the block piece and the workpiece independently of the circumferential profile of the outer circumferential surface of the block piece and the rotational angle position of the block piece about the workpiece axis of rotation.

3. A device according to claim 1, characterized in that the nozzle guide section comprises a control plate which cooperates with at least one control cam so as to set an angle of incidence at which the high-pressure jet of pressure medium is incident on the point of incidence in the edge region between block piece and workpiece during the deblocking.

4. A device according to claim 1, characterized in that the workpiece has a first optically effective surface and a second optically effective surface and prior to the deblocking is blocked by the first optically effective surface on the blocking surface of the block piece, wherein a withdrawal device with a suction head is provided, which for the deblocking can be acted on by a sub-atmospheric pressure in order to firmly suck against the second optically effective surface so that a withdrawing force can be applied to the workpiece by the withdrawing device via the suction head.

5. A device according to claim 4, characterized in that the withdrawal device comprises a manually actuable piston-cylinder arrangement, which is pneumatically connected with the suction head, for generating a sub-atmospheric pressure.

6. A device according to claim 4, characterized in that the withdrawal device comprises a second lever mechanism, by which the suction head is manually pivotable from a rest position to a suction position and vice versa, and at least one spring, which through pivoting of the suction head from the rest position thereof to the suction position can be biased in order to generate the withdrawing force.

7. A device according to claim 6, characterized in that the piston-cylinder arrangement is operatively connected with the second lever mechanism so that by way of the pivot movement of the second lever mechanism the piston-cylinder arrangement is also actuable in order to generate the sub-atmospheric pressure.

8. A device for deblocking optical workpieces, particularly spectacle lenses, comprising:

a first movement device for rotating a workpiece, which is blocked on a block piece, about a workpiece axis of rotation, a nozzle for delivery of a high-pressure jet of a pressure medium in a direction substantially transverse to the workpiece axis of rotation onto a point of incidence in an edge region between the block piece and the workpiece, and a second movement device for generating a relative movement between the nozzle and the workpiece, the second movement device having a nozzle guide section on which the nozzle is mounted and by which the nozzle is positionable with respect to the block piece under cam control in order to direct the high-pressure jet of pressure medium in defined manner onto the point of incidence, wherein the nozzle guide section comprises a scanning arm which can be brought into operative engagement with an outer circumferential surface of the block piece in order to maintain a substantially constant clear spacing during deblocking between an outlet opening of the nozzle and the point of incidence of the high-pressure jet of the pressure medium in the edge region between the block piece and the workpiece independently of the circumferential profile of the outer circumferential surface of the block piece and the rotational angle position of the block piece about the workpiece axis of rotation, and wherein the scanning arm can be brought by way of a scanning roller rotatably mounted thereon into operative engagement with the outer circumferential surface of the block piece.

9. A device according to claim 8, characterized in that the nozzle guide section comprises a control plate which cooperates with at least one control cam so as to set an angle of incidence at which the high-pressure jet of pressure medium is incident on the point of incidence in the edge region between block piece and workpiece during the deblocking.

10. A device according to claim 9, characterized in that the second movement device comprises a first lever mechanism, to which the nozzle guide section is pivotably coupled and by which the nozzle guide section is movable from a rest position to a working position and vice versa.

11. A device according to claim 10, characterized in that the first movement device comprises a spindle which at one end thereof carries the collet chuck for the block piece and at the other end thereof is operatively connected with a handwheel by way of which the spindle and thus the collet chuck are manually rotatable for the deblocking.

12. A device according to claim 11, characterized in that the workpiece has a first optically effective surface and a second optically effective surface and prior to the deblocking is blocked by the first optically effective surface on the blocking surface of the block piece, wherein a withdrawal device with a suction head is provided, which for the deblocking can be acted on by a sub-atmospheric pressure in order to firmly suck against the second optically effective surface so that a withdrawing force can be applied to the workpiece by the withdrawing device via the suction head.

13. A system including a device for deblocking an optical workpiece, particularly a spectacle lens, comprising:

a block piece and workpiece assembly, a first movement device, for rotating the block piece and workpiece assembly, about an axis of rotation of said workpiece, wherein the workpiece is blocked on a defined curved blocking surface of the block piece, a nozzle with an opening for delivery of a high-pressure jet of a pressure medium in a direction substantially transverse to the workpiece axis of rotation onto a point of incidence in an edge region between the block piece and the workpiece, and a second movement device for generating a relative movement between the nozzle and the workpiece, wherein the second movement device has a nozzle guide section on which the nozzle is mounted and by which the nozzle is positionable with respect to the block piece under cam control depending on the curvature of the blocking surface of the block piece in order to direct the high-pressure jet of pressure medium in defined manner onto the point of incidence constructed such that during deblocking the high-pressure jet of pressure medium is set to be incident on the point of incidence at a predetermined incidence angle, the nozzle guide section comprising a control plate which co-operates with at least one control cam so as to set the incidence angle at which the high-pressure jet of pressure medium is incident on the point of incidence in the edge region between block piece and workpiece during the deblocking, wherein the block piece has a clamping section for reception in a collet chuck of the first movement device, wherein the defined curved blocking surface faces away from the clamping section, for fastening of the workpiece, and wherein the at least one control cam has a control surface curved in accordance with the curvature of the blocking surface of the block piece.

14. A system according to claim 13, characterized in that the blocking surface of the block piece is of spherical construction, whereas the control surface of the at least one control cam is arcuately curved, wherein the at least one control cam is so positionable with respect to the collet chuck that the spherical blocking surface of the block piece received in the collet chuck and the arcuately curved control surface of the at least one control cam are arranged concentrically with respect to a notional center point on the workpiece axis of rotation.

15. A system according to claim 13, characterized by a plurality of control cams, which are mounted on a common cam holder, with differently curved control surfaces, wherein the cam holder is constructed to be positionable with respect to the control plate of the nozzle guide section so that depending on the curvature of the blocking surface of the respectively clamped block piece a matching control cam is positionable opposite the control plate.

16. A device for deblocking optical workpieces, particularly spectacle lenses, comprising:

a first movement device for rotating a workpiece, which is blocked on a block piece, about a workpiece axis of rotation, a nozzle for delivery of a high-pressure jet of a pressure medium in a direction substantially transverse to the workpiece axis of rotation onto a point of incidence in an edge region between the block piece and the workpiece, and a second movement device for generating a relative movement between the nozzle and the workpiece, the second movement device having a nozzle guide section on which the nozzle is mounted and by which the nozzle is positionable with respect to the block piece under cam control in order to direct the high-pressure jet of pressure medium in defined manner onto the point of incidence, wherein the nozzle guide section comprises a control plate which co-operates with at least one control cam so as to set an angle of incidence at which the high-pressure jet of pressure medium is incident on the point of incidence in the edge region between block piece and workpiece during the deblocking, and wherein the control plate can be brought by way of two guide rollers, which are rotatably mounted thereon and the axes of rotation of which are spaced from one another, into operative connection with the at least one control cam.

17. A device for deblocking optical workpieces, particularly spectacle lenses, comprising:

a first movement device for rotating a workpiece, which is blocked on a block piece, about a workpiece axis of rotation, a nozzle for delivery of a high-pressure jet of a pressure medium in a direction substantially transverse to the workpiece axis of rotation onto a point of incidence in an edge region between the block piece and the workpiece, and a second movement device for generating a relative movement between the nozzle and the workpiece, the second movement device having a nozzle guide section on which the nozzle is mounted and by which the nozzle is positionable with respect to the block piece under cam control in order to direct the high-pressure jet of pressure medium in defined manner onto the point of incidence, wherein the nozzle guide section comprises a control plate which co-operates with at least one control cam so as to set an angle of incidence at which the high-pressure jet of pressure medium is incident on the point of incidence in the edge region between block piece and workpiece during the deblocking;

wherein the nozzle guide section comprises a nozzle holder on which the nozzle is mounted, and wherein the nozzle holder is connected with the control plate to be angularly adjustable.

18. A device for deblocking optical workpieces, particularly spectacle lenses, comprising:

a first movement device for rotating a workpiece, which is blocked on a block piece, about a workpiece axis of rotation, a nozzle for delivery of a high-pressure jet of a pressure medium in a direction substantially transverse to the workpiece axis of rotation onto a point of incidence in an edge region between the block piece and the workpiece, and a second movement device for generating a relative movement between the nozzle and the workpiece, the second movement device having a nozzle guide section on which the nozzle is mounted and by which the nozzle is positionable with respect to the block piece under cam control in order to direct the high-pressure jet of pressure medium in defined manner onto the point of incidence, wherein the second movement device comprises a first lever mechanism, to which the nozzle guide section is pivotably coupled and by which the nozzle guide section is movable from a rest position to a working position and vice versa.

19. A device according to claim 18, characterized by a protective hood which is selectively movable from a closed position, in which it closes a working space of the device, to an open position, in which it allows access to the working space, and vice versa, wherein the first lever mechanism is so constrainedly coupled with the protective hood that in the closed position of the protective hood the nozzle guide section is disposed in its working position, whereas in the open position of the protective hood the nozzle guide section is disposed in its rest position.

20. A device according to claim 19, characterized in that the first lever mechanism is constrainedly coupled with the protective hood via a cable pull.

21. A device according to claim 19, characterized by an electrically driven high-pressure pump which is disposed in fluid connection with the nozzle and which is selectively activatable by way of a switch arrangement, wherein the switch arrangement is actuable by slight manual lowering of the protective hood out of the closed position thereof against a spring force.

22. A device for deblocking optical workpieces, particularly spectacle lenses, comprising:

a first movement device for rotating a workpiece, which is blocked on a block piece, about a workpiece axis of rotation, a nozzle for delivery of a high-pressure jet of a pressure medium in a direction substantially transverse to the workpiece axis of rotation onto a point of incidence in an edge region between the block piece and the workpiece, and a second movement device for generating a relative movement between the nozzle and the workpiece, the second movement device having a nozzle guide section on which the nozzle is mounted and by which the nozzle is positionable with respect to the block piece under cam control in order to direct the high-pressure jet of pressure medium in defined manner onto the point of incidence, wherein the first movement device comprises a spindle which at one end thereof carries the collet chuck for the block piece and at the other end thereof is operatively connected with a handwheel by way of which the spindle and thus the collet chuck are manually rotatable for the deblocking.

* * * * *